US005916868A

United States Patent [19]

Mazzola et al.

[11] Patent Number: 5,916,868

[45] Date of Patent: Jun. 29, 1999

[54] PROCESS FOR PREPARING A FREE-FLOWING HIGH BULK DENSITY GRANULAR DETERGENT PRODUCT

[75] Inventors: Louis R. Mazzola, Mahwah, N.J.; Anthony J. Falotico, Doylestown, Pa.

[73] Assignee: Church & Dwight Co., Inc, Princeton, N.J.

[21] Appl. No.: 09/107,133

[22] Filed: Jun. 30, 1998

Related U.S. Application Data

[62] Division of application No. 08/732,785, Oct. 15, 1996, Pat. No. 5,807,817.

[51] Int. Cl.[6] ..... C11D 11/00

[52] U.S. Cl. ..... 510/444; 510/351; 510/441; 510/497; 510/509; 510/510; 510/511; 510/512; 264/117; 264/140

[58] Field of Search ..... 510/444, 441, 510/351, 497, 509, 510, 511, 512; 264/117, 140

[56] References Cited

U.S. PATENT DOCUMENTS

| | | | |
|---|---|---|---|
| 4,188,447 | 2/1980 | Ehlenz | 428/310 |
| 4,427,417 | 1/1984 | Porasik | 23/313 R |
| 4,487,710 | 12/1984 | Kaminsky | 510/352 |
| 4,761,248 | 8/1988 | Clift | 510/444 |
| 5,180,515 | 1/1993 | Boucher et al. | 510/359 |
| 5,332,519 | 7/1994 | Mazzola | 510/351 |
| 5,431,836 | 7/1995 | Carr et al. | 510/348 |
| 5,496,376 | 3/1996 | Falotico et al. | 510/349 |
| 5,516,448 | 5/1996 | Capeci et al. | 510/441 |
| 5,529,710 | 6/1996 | Van Dijk et al. | 510/404 |
| 5,554,587 | 9/1996 | Capeci | 510/444 |
| 5,691,294 | 11/1997 | France et al. | 510/349 |
| 5,691,297 | 11/1997 | Nassano et al. | 510/444 |
| 5,807,817 | 9/1998 | Mazzola et al. | 510/349 |

*Primary Examiner*—Lorna Douyon
*Attorney, Agent, or Firm*—Irving Fishman

[57] ABSTRACT

A process for preparing a free-flowing high bulk density granular laundry detergent product comprises pre-blending a powder admixture comprising (1) between about 40–90 weight percent of a water soluble detergent builder wherein at least 70 weight percent of the detergent builder is sodium carbonate, and (b) between about 0.5–10 weight percent of alkali metal chloride salt, (2) forming a builder-surfactant powder by blending the step (1) admixture with between about 5–40 weight percent of a detergent active ingredient which is a blend of sulfated ethoxylated alcohols and nonionic ethoxylated alcohols, (3) subjecting the builder-surfactant powder to treatment with water under agglomerating conditions, and (4) drying the detergent composition to provide a free-flowing granular laundry detergent product having a bulk density of at least 650 grams per liter, and in which the detergent granule surfaces are coated with a glossy shell of alkali metal salt crystallites.

9 Claims, 1 Drawing Sheet

Figure 1:
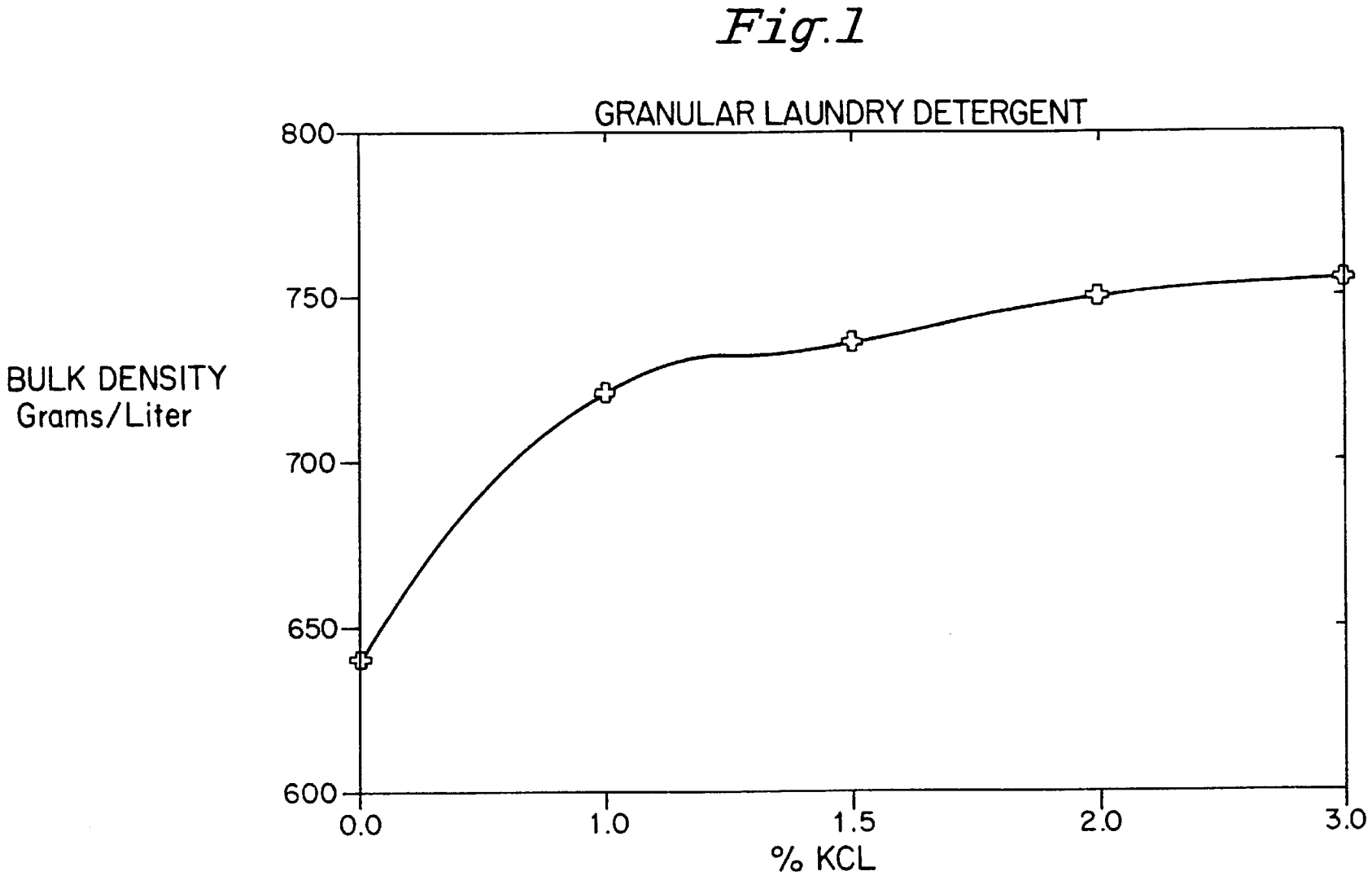

PROCESS FOR PREPARING A FREE-FLOWING HIGH BULK DENSITY GRANULAR DETERGENT PRODUCT

This application is a division of prior application U.S. Ser. No. 08/732,785 filed on Oct. 15, 1996 now U.S. Pat. No. 5,807,817.

BACKGROUND OF THE INVENTION

There is an increasing trend in the detergent industry toward the development of free-flowing and comparatively high bulk density particulate heavy duty laundry detergents, which can be utilized in relatively low dosages for effective heavy duty textile laundering operations. High bulk density detergents are packaged in smaller boxes, with attendant lower packing, storage and shipping costs.

Processes for the production of free-flowing laundry detergents with a relatively high bulk density (i.e., above about 600 grams per liter) are described in prior art references such as U.S. Pat. Nos. 4,237,024; 4,761,248; 4,427,417; 5,486,303; 5,489,392; and 5,516,448; incorporated by reference.

The reference processes typically employ new types of agglomerating equipment such as a Lodige KM-600 mixer/densifier, which are characterized by high energy input and long residence time, and multiple screening and recycling procedures to achieve a free-flowing high bulk density laundry detergent product.

Accordingly, it is an object of this invention to provide an improved free-flowing high bulk density granular detergent composition.

It is another object of this invention to provide a novel process which employs conventional mixing and agglomerating equipment for production of a free-flowing high bulk density granular laundry detergent composition.

It is a further object of this invention to provide a process which employs low intensity blending and agglomerating procedures and a short residence time for production of a free-flowing high bulk density granular laundry detergent composition with unique particle compacting properties.

Other objects and advantages of the present invention shall become apparent from the accompanying description and examples.

DESCRIPTION OF THE INVENTION

One or more objects of the present invention are accomplished by the provision of a process for the production of a free-flowing high bulk density granular laundry detergent product, which process comprises (1) pre-blending a powder admixture comprising (a) between about 40–90 weight percent of a water soluble detergent builder ingredient wherein at least 70 weight percent of the detergent builder ingredient is sodium carbonate, and (b) between about 0.5–10 weight percent of alkali metal chloride salt ingredient, wherein the powder admixture weight percent is based on the weight of detergent product of the process; (2) forming a builder-surfactant powder by blending the step(1) admixture with between about 5–40 weight percent of a detergent active ingredient which is a surfactant blend comprising (a) between about 40–80 weight percent, based on the surfactant weight, of an anionic salt compound corresponding to the formula:

$$R—O—(CH_2CH_2O)_n—SO_3M$$

where R is a $C_{10}$–$C_{15}$ alkyl group, n is an average number of ethoxylate groups between about 1–9, and M is an alkali metal or ammonium cation, and (b) between about 20–60 weight percent, based on surfactant weight, of a nonionic compound corresponding to the formula:

$$R—O—(CH_2CH_2O)_n—H$$

where R is a $C_{10}$–$C_{15}$ alkyl group, and n is an average number of ethoxylate groups between about 1–9, wherein the weight percent of the builder-surfactant powder is based on the weight of detergent product of the process; (3) subjecting the builder-surfactant powder to treatment with water under agglomerating conditions to form a granular detergent composition; (4) and drying the detergent composition to provide a free-flowing granular laundry detergent product which has a bulk density of at least about 650 grams per liter, and in which the detergent granule surfaces are coated with a glossy shell of alkali metal chloride salt crystallites.

In another embodiment this invention provides a free-flowing high bulk density laundry detergent product which is a granulated blend of ingredients comprising (1) between about 40–90 weight percent of a water soluble detergent builder ingredient wherein at least 70 weight percent of the detergent builder ingredient is sodium carbonate; (2) between about 0.5–10 weight percent of alkali metal salt ingredient; and (3) between about 5–40 weight percent of a detergent active ingredient which is a surfactant blend comprising (a) between about 40–80 weight percent, based on the surfactant weight, of an anionic salt compound corresponding to the formula:

$$R—O—(CH_2CH_2O)_n—SO_3M$$

where R is a $C_{10}$–$C_{15}$ alkyl group, n is an average number of ethoxylate groups between about 1–9, and M is an alkali metal or ammonium cation, and (b) between about 20–60 weight percent, based on surfactant weight, of a nonionic compound corresponding to the formula:

$$R—O—(CH_2CH_2O)_n—H$$

where R is a $C_{10}$–$C_{15}$ alkyl group, and n is an average number of ethoxylate groups between about 1–9; wherein the detergent product has a bulk density of at least about 650 grams per liter, and the detergent granule surfaces are coated with a glossy shell of alkali metal chloride salt crystallites.

The detergent active surfactant blend ingredient of a present invention laundry detergent product preferably has a content between about 50–65 weight percent of anionic sulfate salt compound, based on surfactant weight, and most preferably between about 50–60 weight percent.

A present invention laundry detergent product exhibits excellent cold water residue properties when it includes the above represented surfactant blend composition as an ingredient, and the R alkyl group in the nonionic and anionic formulas is a $C_{10}$–$C_{15}$ alkyl substituent, and preferably is a $C_{12}$–$C_{14}$ alkyl or $C_{12}$–$C_{13}$ alkyl mixture.

Suitable water-soluble detergent builder compounds for a present invention laundry detergent product as defined herein include alkali metal and ammonium carbonates, bicarbonates, sesquicarbonates, silicates, phosphates, orthophosphates, pyrophosphates, tripolyphosphates, silicates, borates, and the like. Sodium and potassium carbonates, bicarbonates and sesquicarbonates are illustrative of preferred types of inorganic salt detergent builder compounds. A present invention laundry detergent product typically has a detergent builder content between about 0.1–4.5 weight percent of phosphate salt, and preferably has a content less than about 2 weight percent of phosphate salt.

Other types of detergent builders include sequestering compounds such as alkali metal and ammonium salts of nitrilotriacetate, polyhydroxysulfonate, oxydisuccinate, polysaccharide carboxylate, and the like; and ion-exchange compounds such as amorphous and crystalline aluminosilicates; as disclosed in U.S. Pat. No. 3,868,336, U.S. Pat. No. 4,473,485 and U.S. Pat. No. 4,695,284, incorporated by reference.

The term "water-soluble" as employed herein refers to a chemical compound which has a solubility of at least about 2 grams per 100 grams of water at 25° C.

An essential aspect of a present invention detergent product is the incorporation of between about 0.5–10 weight percent of alkali metal chloride salt, such as potassium chloride or sodium chloride or a mixture thereof.

During the agglomerating procedure in step(3) of the invention process, the solubilizing effect of the water treatment on the builder-surfactant granules causes the efflorescence of alkali metal chloride salt, and the formation of a non-tacky hard glossy shell of alkali metal chloride salt crystallites on the surfaces of the granules. The said glossy coating facilitates free-flowing and tight-packing of the granule particles into a high bulk density compact mass. A present invention detergent product typically has a bulk density between about 700–760 grams per liter, and preferably between about 720–760 grams per liter.

A present invention laundry detergent product can contain other optional detergent adjuncts, which include lather boosters such as alkanolamines, lather depressants such as alkyl phosphates or silicones, anti-redeposition agents such as sodium carboxymethylcellulose, oxygen-releasing bleaching agents such as sodium perborate or sodium percarbonate, fabric softening agents, fluorescent agents, perfumes, enzymes, germicides, colorants, and the like.

A preferred type of anti-redeposition agent is sodium polyacrylate having a molecular weight of 2000–50,000.

It is generally desirable to incorporate between about 1–15 weight percent of alkali metal silicate such as sodium or potassium silicate in the laundry detergent composition to provide buffering capacity and to prevent corrosion of metal parts in washing machines.

The detergent active surfactant blend ingredient of a present invention laundry detergent product can be prepared by a partial sulfation procedure similar to that described in U.S. Pat. No. 4,464,292, incorporated by reference.

In a typical sulfation procedure, a nonionic ethoxylated alcohol mixture, such as Neodol 23-3 (Shell), is admixed with 96–100% concentrated sulfuric acid, in a proportion of about 1–2 moles of sulfuric acid per mole of nonionic ethoxylated alcohol mixture. The exothermic reaction admixture is maintained at a temperature between about 120°–180° F. for a sufficient period between about 0.5–45 minutes to convert about 40–80 weight percent of the initial ethoxylated alcohol mixture to a sulfate ester derivative.

The resulting partially sulfated nonionic ethoxylated alcohol blend is a liquid mixture of residual unsulfated ethoxylated alcohols, and sulfated ethoxylated alcohols, and lesser quantities of residual unsulfated unethoxylated alcohols, and sulfated unethoxylated alcohols.

A commercial nonionic ethoxylated alcohol product such as Neodol 23-3 is composed of a liquid mixture of $C_{12}$–$C_{13}$ alcohols which have an average content of three ethoxylate groups per alcohol molecule. A commercial nonionic ethoxylated alcohol product such as Neodol 23-3 typically has a content of up to about 20 weight percent of unethoxylated alcohols such as $C_{12}$–$C_{13}$ alcohols. Nominally 24-3 refers to a mixture of $C_{12}$–$C_{14}$ alcohols which have an average content of three ethoxylate groups per alcohol molecule.

The partially sulfated surfactant blend is neutralized with a basic reagent such as alkali metal or ammonium hydroxide or carbonate. For purposes of the present invention, the neutralization of the partially sulfated surfactant blend is effected by dry mixing of the surfactant blend with the builder/chloride salt pre-blend in step(2) of the invention process.

The following description illustrates a process embodiment for preparation of a present invention free-flowing high bulk density granular laundry detergent product.

Soda ash is fed into a milling system to grind the soda ash into a fine powder, which then is pre-blended with alkali metal chloride salt ingredient. The soda ash/chloride salt powder admixture is fed into a continuous blender (e.g., a Bepex Turbulizer), where the liquid partially sulfated surfactant blend (e.g., Neodol 23-3) is sprayed onto the powder admixture. The final laundry detergent product has superior cold water residue properties when the liquid surfactant blend is evenly distributed throughout the soda ash powder during this initial blending stage. The residence time of the ingredient admixture in the blender typically is between about 1–10 seconds.

The resultant builder-surfactant powder is agglomerated by spraying with between about 5–20 weight percent of water to granulate the powder in step(3) of the invention process. The damp product is passed through a fluid bed dryer where approximately one half of the moisture is removed in step(4) of the invention process. The particle size of the detergent granules in step(4) is substantially in the range between about 200–1200 microns.

The granular product is discharged from the dryer through cooler beds. After cooling, optional ingredients such as carboxymethylcellulose, sodium tripolyphosphate, sodium silicate, sodium bicarbonate, brightener and perfume can be added by conventional means.

The finished product is passed through a Rotex screener to remove oversize particles (+6 mesh), and then the screened product is transferred to a package filling unit.

A present invention granular laundry detergent product can be manufactured with conventional processing equipment such as Bepex Turbulizer, Schugi agglomerator, pan agglomerator and O'Brien drum blender.

A present invention granular laundry detergent product is characterized by free-flow and high bulk density properties, which mainly are attributable to the unique glossy shell coating of alkali metal chloride salt crystallites on the detergent granule surfaces.

A present invention granular laundry detergent product also exhibits superior cold water residue properties, which mainly are attributable to the content of the partially sulfated and neutralized nonionic/ionic surfactant ingredient which has the specifications described herein.

The following examples are further illustrative of the present invention. The components and specific ingredients are presented as being typical, and various modifications can be derived in view of the foregoing disclosure within the scope of the invention.

FIG. 1 is a graphic representation of the effect of different weight contents of an alkali metal chloride ingredient on the bulk density of a granular laundry detergent product. The graphic representation in FIG. 1 has correspondence with the comparative test data in Example II.

EXAMPLE I

This Example illustrates the preparation of a partially sulfated ethoxylated alcohol surfactant blend for use in the following examples.

Neodol 23-3 (ethoxylated $C_{12}$–$C_{13}$ alcohol (n=3) available from Shell Chemical Company) is reacted with concentrated sulfuric acid and stirred for about 30 minutes. The reaction temperature is controlled in the range of 120–135° F. during the reaction period.

The degree of conversion of the Neodol 23-3 to the sodium sulfated ether product is about 58%, with the remainder of the alcohol being unsulfated Neodol 23-3 ethoxylated alcohol.

EXAMPLE II

This Example illustrates the preparation of a conventional granular laundry detergent product.

Following the general procedure described in the specification (except that the composition contains no alkali metal chloride salt), a control granular laundry detergent product is prepared which is composed of the following ingredients:

| Component | Wt. % of Product |
|---|---|
| Sodium Carbonate | 80.18 |
| Sodium Neodol 23-3 Sulfate | 6.00 |
| Neodol 23-3 | 3.30 |
| Acusol 912N (sodium polyacrylate Rohmn & Haas) | 0.60 |
| Triazinyl stilbene (Optical brightener) | 0.20 |
| Sodium Carboxymethylcellulose | 0.20 |
| Sodium Tripolyphosphate | 1.40 |
| Sodium Sulfate | 2.00 |
| Water | 6.00 |
| Fragrance | 0.12 |
| | 100.00 |

The control granular laundry detergent product has a bulk density of 640 grams per liter and a free flow value of 11. The free flow test consists of a set of funnels with decreasing orifice size. Granular detergent product is placed in the top funnel with the widest opening. The bottom is opened and if the granular product flows into the next funnel below, the step is repeated. When the granular product no longer flows out one of the funnels the test is completed. The funnels are numbered such that the lower value represents better flow properties.

EXAMPLE III

Example II is repeated except that 3% (relative to the total composition) of the sodium carbonate is replaced by an equal weight of potassium chloride which is added only after completion of the agglomeration, drying, and cooling steps. The potassium chloride is dry-blended (along with the optional and minor components which are also added after these steps) with the cooled dry agglomerates. The product of this Example also has a bulk density of 640 grams per liter and a free flow value of 11.

EXAMPLES IV–VII

These Examples illustrate the preparation of granular laundry detergent products which have improved free-flow and high density properties in accordance with the present invention.

The detergent products have the same composition as illustrated in Example II, except that a portion of the sodium carbonate is replaced with potassium chloride in the amounts indicated in the following table.

The potassium chloride is pre-blended with the sodium carbonate before the addition of other ingredients and before agglomeration. Resultant bulk density and free-flow values are listed in the Table.

TABLE

| | Example | | | |
|---|---|---|---|---|
| Ingredient | IV | V | VI | VII |
| Sodium Carbonate (wt %) | 79.18 | 78.68 | 78.18 | 77.18 |
| Potassium Chloride (wt %) | 1.00 | 1.50 | 2.00 | 3.00 |
| Bulk Density (grams/liter) | 721 | 735 | 750 | 760 |
| Flow Value | 8 | 7 | 6 | 6 |

The bulk density of Examples II and IV–VII are shown graphically in FIG. 1. The control granular detergent product has granule particles which are slightly tacky, and do not have the free-flowing and tight packing properties of the invention detergent products (Examples IV–VII) which have potassium chloride present (pre-blended with the sodium carbonate). In addition, the granules of the invention detergent products have a visually observable non-tacky hard glossy shell coating of potassium chloride crystallites on the granule surface.

By way of comparison, the control detergent product of Example III (having potassium chloride merely dry blended after agglomeration, drying and cooling), does not have the bulk density nor the free-flow properties of the invention detergent products. The control product of Example III has essentially the same bulk density and free-flow properties as the Example II control product (no potassium chloride).

EXAMPLE VIII

Repetition of Examples III–VII (except that sodium chloride is used in place of potassium chloride) with procedures and quantities corresponding to the respective Examples yields results analogous to those reported in Examples III and IV–VII respectively. The inclusion of sodium chloride in a dry-blending step after agglomeration, drying and cooling have taken place results in properties similar to those described in Example III. In contrast, the inclusion of the sodium chloride, as a pre-blend with sodium carbonate before agglomeration takes place, results in improved bulk density and free-flow properties similar to those reported in Examples IV–VII above.

Use of alternative water-soluble additives such as sodium citrate in place of the sodium chloride or potassium chloride results in less satisfactory improvements in bulk density and free-flow properties.

What is claimed is:

1. A process for the production of a free-flowing high bulk density granular laundry detergent product, which process comprises (1) pre-blending a powder admixture comprising (a) between about 40–90 weight percent of a water soluble detergent builder ingredient wherein at least 70 weight percent of the detergent builder ingredient is sodium carbonate, and (b) between about 0.5–10 weight percent of alkali metal chloride salt ingredient, wherein the weight percent of the detergent builder ingredient and the alkali metal chloride salt ingredient are based on the weight of the granular laundry detergent product; (2) forming a builder-surfactant powder by blending the step(1) admixture with between about 5–40 weight percent of a detergent active ingredient which is a surfactant blend comprising (a) between about 40–80 weight percent, based on the surfactant weight, of an anionic salt compound corresponding to the formula:

$$R—O—(CH_2CH_2O)_n—SO_3M$$

where R is a $C_{10}$–$C_{15}$ alkyl group, n is an average number of ethoxylate groups between about 1–9, and M is an alkali metal or ammonium cation, and (b) between about 20–60 weight percent, based on surfactant weight, of a nonionic compound corresponding to the formula:

$$R—O—(CH_2CH_2O)_n—H$$

where R is a $C_{10}$–$C_{15}$ alkyl group, and n is an average number of ethoxylate groups between about 1–9, wherein the weight percent of the detergent active ingredient is based on the weight of the granular laundry detergent product; (3) subjecting the builder-surfactant powder to treatment with water under agglomerating conditions to form a granular detergent composition; (4) and drying the detergent composition to provide a free-flowing granular laundry detergent product which has a bulk density of at least about 650 grams per liter, and in which the detergent granule surfaces are coated with a glossy shell of alkali metal chloride salt crystallites.

2. A process in accordance with claim 1 wherein the alkali metal chloride salt in step(1) is potassium chloride or sodium chloride or a mixture thereof.

3. A process in accordance with claim 1 wherein the residence time for the step(2) blending procedure is between about 1–10 seconds.

4. A process in accordance with claim 1 wherein the agglomerating procedure in step(3) is conducted with between about 5–20 weight percent of water, based on the weight of builder-surfactant powder.

5. A process in accordance with claim 1 wherein the bulk density of the detergent product in step(4) is between about 700–760 grams per liter.

6. A process in accordance with claim 1 wherein the particle size of the detergent granules in step(4) is substantially in the range between about 200–1200 microns.

7. A process in accordance with claim 1 in which one or more optional ingredients are blended into the detergent product in an additional step(5), said optional ingredients being selected from the group consisting of lather boosters, lather depressants, anti-redeposition agents, oxygen-releasing bleaching agents, fabric softening agents, fluorescent agents, perfumes, enzymes, germicides, colorants and mixtures thereof.

8. A process in accordance with claim 1 in which between about 1–15 weight percent of alkali metal silicate corrosion inhibitor is blended into the detergent product in an additional step(5).

9. A process in accordance with claim 1 in which between about 0.1–4.5 weight percent of alkali metal phosphate is blended into the detergent product in an additional step(5).

* * * * *